United States Patent [19]

Gerstung

[11] Patent Number: 4,958,755

[45] Date of Patent: Sep. 25, 1990

[54] VALVE FOR PRESSURIZED DISPENSING CANS

[75] Inventor: William Gerstung, Santa Clarita, Calif.

[73] Assignee: Gerstung Enterprises, Inc., Miami, Fla.

[21] Appl. No.: 380,562

[22] Filed: Jul. 17, 1989

Related U.S. Application Data

[63] Continuation-in-part of Ser. No. 171,070, Mar. 21, 1988, Pat. No. 4,856,684, and a continuation of Ser. No. 113,995, Oct. 29, 1987, abandoned, and Ser. No. 34,679, Apr. 6, 1987, abandoned.

[51] Int. Cl.[5] ..... B65D 83/46

[52] U.S. Cl. ..... 222/402.23; 251/354

[58] Field of Search ..... 222/402.21–402.25, 222/394; 251/354

[56] References Cited

U.S. PATENT DOCUMENTS

| | | | |
|---|---|---|---|
| 2,612,293 | 9/1952 | Michel | 222/402.23 |
| 2,994,461 | 8/1961 | Michel | 222/402.22 |
| 3,722,760 | 3/1973 | Hug | 222/402.22 |
| 3,954,208 | 5/1976 | Brill | 222/402.23 |
| 4,008,834 | 2/1977 | Towns | 222/402.23 |
| 4,171,074 | 10/1979 | Diamond | 222/402.22 |
| 4,765,516 | 8/1988 | Metcoff et al. | 222/402.22 |

*Primary Examiner*—Michael S. Huppert
*Attorney, Agent, or Firm*—J. Sanchelima

[57] ABSTRACT

The valve is for use on a gas pressurized liquid food dispensing container or can, such as a whipped cream dispensing can. The valve includes a dish-shaped, preferably metal can top connector having a vertical opening up through which extends the vertical rod portion of a valve stem disposed within a passageway in a vertical tubular portion of a rubber grommet. The upper end of the grommet engages the lower end of an expanded head on the stem rod to hold the stem yieldingly in place in assembly. The horizontal lower end of the grommet abuts the lower end of the connector and the upper end of the horizontal base of the valve stem so as to releasably seal the connector opening therewith. The valve stem base includes an inverted skirt peripherally mounted thereon that, with the lower end of the grommet define a circular path for dispensing the product. An open-topped vertical cover is releasably secured around the grommet upper tubular portion, as by ribs or detents or threading and can be tilted sideways with the grommet upper tubular portion to tilt the stem base from its sealing position to release liquid from the can. The lower portion of the stem rod is generally conical and the grommet has an annular ring with pointed inner rim bearing there against for improved sealing engagement, and preventing inadvertent "blow-by" of liquid and solids and build-up of solids from the can. An annular ridge may be provided on the grommet inner passageway wall directly in the tilt path of the sterm base to act as a fulcrum for earlier and easier dispensing from the can.

5 Claims, 1 Drawing Sheet

PRIOR ART

VALVE FOR PRESSURIZED DISPENSING CANS

OTHER RELATED APPLICATIONS

This application is a continuation-in-part application of my earlier filed patent application Ser. No. 171,070 filed on Mar. 21, 1988 now U.S. Pat. No. 4,856,684 and a continuation of my earlier application Ser. No. 113,995 filed on Oct. 29, 1987 and now abandoned and in turn is a continuation of my earlier application Ser. No. 034,679 filed on Apr. 6, 1987, abandoned. The subject matter of these parent applications is incorporated by reference.

BACKGROUND OF THE INVENTION

1. Field of the Invention

The present invention relates to valves, and more particularly, to valves of the type used with pressurized dispensing cans to control removal of contents from such cans.

2. Description of the Related Art

The prior art known to the applicant is the conventional pressurized liquid food dispensing can valve such as is illustrated in FIG. 1 of the accompanying drawings, and such is generally employed to dispense whipped cream and whipped cream-like substances from small containers sold in grocery stores and the like. The valves of such cans generally employ an outer plastic cover having an internal ring detent with upwardly converging walls which are adapted to about the lower surfaces of an arrow-shaped head of the valve stem employed in the valve, making it impossible to retract the valve stem once the head is shoved up past the detent.

Unfortunately, with this arrangement, the outer cover is locked in place and cannot be removed to expose the valve stem for cleaning. Some of the whipped cream and the like dispensed from the can normally becomes trapped between the cover and valve head and is subject to hardening, decomposition, development of bad smells and rancidity, etc., making it a health hazard and a unsightly mess. Over a period of time, sufficient build-up of whipped cream or the like can occur to even impair the proper operation of the valve.

There generally is also a build-up of such material in the area of contact between the moveable valve stem and its seal, causing gradual oozing out of the dispensing material. There is generally a further problem in the slowness and difficulty encountered in causing the valve to tilt to the dispensing position.

Accordingly, there is a need for an improved valve for pressurized liquid food dispensing cans which will permit easy disassembly and clean-up of the valve without loss of can pressure and which will assure proper operation over a long period of time without becoming a health hazard. Such valve should be simple, durable, inexpensive and efficient. Importantly, such a valve should also include a sealing means effective through a range of pressure, i.e. (a) from a relatively high initial pressure to avoid "blow-by" to (b) a relatively low pressure when the container contents are substantialy discharged to avoid oozing. Also, the valve should dispense rapidly and without difficulty.

Representative prior art includes U.S. Pat. No. 3,447,779 which shows a valve for the purpose described herein generally, namely, dispensing flowable material from a pressurized container. That patent, however, does not include the sealing structure as is described more fully herein. The prior art also includes U.S. Pat. No. 3,954,208 provides a dispensing valve structure with a different type of sealing means than is disclosed herein. Similarly, U.S. Pat. Nos. 2,487,434, 3,450,316 and 3,079,048 disclose structures of valves for pressurized containers without the improved sealing means of this invention.

The above referenced parent application (Ser. No. 171,070) has resolved many of the problems of the prior art. However, a problem was still unsolved and it is addressed in the present application. This problem relates to the dispensing of the last remaining liquid food in a container, typically placed in an upside down position when being dispensed from. Manufacturers typically add an overfill of the product in the container to insure that the advertised amount of the product is dispensed. With the present improved valve, this overfill requirement is substantially minimized with the consequent savings for the manufacturers.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a valve that permits dispensing of the residual liquid food left in a pressurized container.

It is yet another object to this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
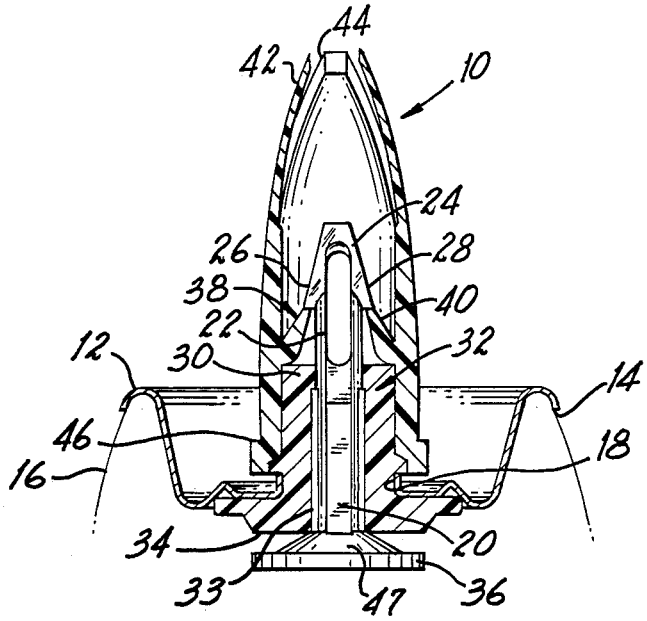
FIG. 1 represents a schematic side elevation, partly broken away, of a conventional prior art valve for a liquid dispensing can.

Referring now to FIG. 1, where the present invention is generally referred to with numeral 10, it can be observed that valve 10 is shown which comprises a dish-shapd metal connected 12 sealingly engageable with the top 14 of a pressurized liquid food dispensing can 16 or the like. Connector 12 has a central vertical opening 18 extending up therethrough, up through which passes the vertical rod 20 of a valve stem 22. The upper end of rod 20 bears an expanded arrow-shaped head 24 having a pair of downwardly and outwardly depending flanges 26 and 28.

The upper hollow tubular portion 30 of a rubber grommet 32 is disposed around the lower portion of rod 20 vertical in passageway defined by the wall 33 of grommet 32. Grommet 32 passes down through opening 18 to connect with an expanded horizontal disc-shaped base 34 of grommet 32. Base 34 abuts the underside of connector 12 and serves as a seal for the expanded horizontal base 36 of valve stem 22. Base 36 is connected to the lower end of rod 20 and serves to releasably close opening 18.

Valve stem 22 is held in the closed position shown in FIG. 1 by a circular ring detent 38 having upwardly converging walls 40 which engage the underside of overlying flanges 26 and 28. Walls 40 are integrally connected to the inner surface of hollow tubular cover 42, the upper end 44 of which is open and tulip shaped and the lower end 46 of which is open and expanded to seat on the upper surface of connector 12 over portion 30 of grommet 32. Preferably, cover 42 is plastic with slight flexibility and walls 40 may be split to facilitate their spreading.

Grommet 32 contacts the conical-shaped lower portion 47 of rod 20 as at the zone indicated at the lower end of grommet wall 33. Such seal characteristically tends to trap entrained solids from the material dispensed from can 16 and to cause an undesirable slow leaking of material from can 16 as the seal becomes more and more ineffective.

When valve 10 is assembled, cover 42 is the last component to be put in place. As it is pushed down over rod 20 and head 24, head 24 is forced up through ring detent 38, expanding detent 38 slightly until head 24 reaches the position in FIG. 1. In this position, cover 42 is locked on valve 10 and cannot be removed. Walls 40 are trapped below flanges 26 and 28 and hold stem 22. Valve 10 is operated by pivoting or tilting cover 42 and grommet portion 30 sideways under finger pressure to cause stem base 36 to tilt away from grommet base 34 and thus expose a pathway past 47 for passage of pressurized liquid from can 16. Release of such side pressure effects automatic closing of opening 18. Since in this type structure, cover 42 cannot be removed from stem 22, a part of the dispensed liquid food characteristically becomes trapped between cover 42, grommet 32, rod 20 and head 24, as well as between grommet rim and conical portion 47 of rod 20, causing the aforementioned health hazards.

Figure 2:
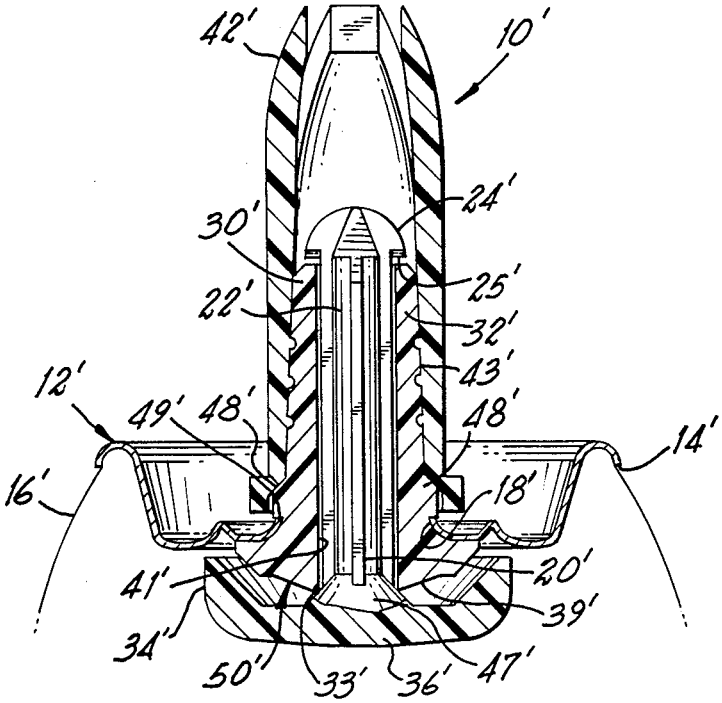
FIG. 2 shows a schematic cross-sectional side elevation illustrating a preferred embodiment of the improved valve of the present invention.

A preferred embodiment may be best understood on initial reference to FIG. 2. In FIG. 2, the components which are generally similar to those of FIG. 1 bear the same numerals but are designated with a prime designation, "'". In FIG. 2, the improved valve 10' is for attachment to the open upper end 14' of a container 16' for controlling the discharge of pressurized, flowable material from the container. The valve includes sealing means which are effective for preventing "blow-by" and oozing through a range of pressures from an initial elevated pressure to a lower pressure when the flowable material is substantially discharged from the container. More in detail, the valve 10' is seen to include a can connector 12', a valve stem 22', a grommet 32' and an open-topped vertical cover 42'. Can connector 12' is of rigid material and, as is conventional, is adapted to sealingly close a container about its open upper end. The connector has a vertical opening 18' extending through it which is bounded by an edge 49'. Ordinarily, such connenctors are attached to a pressurized can by crimping.

The valve stem 22' is of rigid material. It is composed of a horizontal base 36 ' positioned below connector 12' when in assembly in the opening 18' of connector 12'. The valve stem includes a generally vertical rod 20' extending upwardly from the base 36' and through opening 18'. Rod 20' includes an upper distal end comprising a peripherally extending expanded, open work or grid type head 24'. This defines a shoulder surface 25' which faces the valve stem base 36' and keeps valve stem 22' from falling off when there is no pressure inside container 16'. Also, the base has a generally conical portion defining a surface 47' extending upwardly and converging from the base 36' to rod 20'. Thus, the upper axially facing surface of the base includes the conical portion surface 47'.

Grommet 32' is tubular having an axial passageway 41' and it is of flexible, resilient material. An inverted dome-shaped axially downwardly facing surface 39' is located at the lower end of passageway 41'. Grommet 32' also includes an upper hollow tubular and vertically extending portion 30' which is disposed about valve stem rod 20' with rod 20' in passageway 41', and with the valve stem base 36' closely adjacent the invertd dome-shaped surface 39'. Grommet 32' also has an outer surface 43' at the upper end of the vertically extending portion 30' which face has been designated by the numeral 43'. In assembly, the surface 25' of the valve stem head which faces the valve stem base 36' dwells on the upper grommet face 43' to hold the valve stem in assembly. Lower termination 33' of passageway 41' confront the upper surface of the valve stem base 36'. Grommet 32', valve and valve stem are sized and configured with the lip 50' in a normal position closely adjacent to the conical surface 47'. Finally, on the exterior surface of grommet 32', there are mutually interengaging means 48' which captivate the edge of the opening of the connector 12' to sealingly close about the edge of that opening 18'.

It is thus seen that grommet lip 50' comprises a sealing ring in the passageway 41' which is in sealing engagement with the generally conical surface 47' of the rod 20' when valve 10' is installed in closing relation on the open upper end of a pressurized container and axially upwardly directed forces are exerted on the valve step base 36' which deforms the inverted dome-shaped surface upwardly as well as the lip 50' at 33'. It is seen that grommet lip 50' is an annular, deformable, pointed grommet portion which is of generally transverse cross-section, as seen in elevation, with the apex 33' of the grommet portion defining a generally radially inwardly and downwardly pointed, distally weakened lip portion for sealing engagement with the conical portion of the rod. Preferably, the bisectrix of the apex is perpendicular to the conical surface 47'. When under pressure, it is seen that the grommet generally dome-shaped surface and the apex 33' are effective to deformingly and sealingly contact the upper axially facing surface of valve stem base 36', including conical portion suface 47' when the container is under elevated, initial pressure to guard against "blow-by" of pressurized liquid and to eliminate entrapment of entrained solids between grommet 32' and valve stem 22', and that as the pressure is reduced, on removal of the flowable material from the container, the pointed, distally weakened lip portion 50' is adapted to gradually relax returning toward its normal position with the apex 33' of lip protion 50' maintaining sealing contact with the conical portion 47'. Base member 36' includes an inverted skirt 34' peripherally mounted thereon. It has been found that this feature further minimizes the problem of product remaining in the container. Thus, a circular path is defined for dispensing the product.

The open tubular vertically extending cover 42' is releasably secured to the tubular portion 30' of grommet 32' above connector opening 18'. This facilitates removal of the cover and cleaning of the rod, rod head, cover and grommet. Preferably, cover 42' is rigid material and has an inside surface closely adjacent the upper vertically extending tubular grommet portion 30' and, also, includes an axially extending portion above grommet 32'. This is so that when cover 42' is tilted by sideways finger pressure, relatively little pressure is required, the axially extending portion of the tubular grommet portion acting as a lever. Thus, grommet 32' may be yielding tilted together with the ribbed valve stem 22' from a normal verical position. This causes a corresponding tilt of the valve stem vase 36' and rod 20' out of sealing engagement of the apex 33' of grommet lip 50' and the upwardly facing surface including the conical portion surface 47' of valve stem rod 20 ' for temporarily dispensing pressurized flowable material from the container. It will be seen that the elasticity of grommet 32' automatically returns stem 22' to a sealing position with the lip portion 50' being in sealing engagement with conical poriton 47' on removal of the tilting pressure.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. An improved valve for attachment to the open upper end of a container for controlling discharge of pressurized, flowable material from the container, said valve including sealing means effective for preventing "blow-by" and oozing through a range of pressures, from an initial, elevated pressure to a lower pressure when the flowable material is substantially discharged from the container, said valve comprising, in combination:

a) a generally horizontally extending can connector of rigid material adapted to sealingly close said container about the open upper end, said connector having a vertical opening extending therethrough bounded by an edge;

b) a valve stem of rigid material comprising a generally horizontal base positioned below said connector and said opening, and said stem including a generally vertical rod extending upwardly from said base and through said opening, said rod including an upper distal end comprising a peripherally extending expanded open work head defining a surface said valve stem base, and said base having a generally conical portion having a surface extending upwardly and converging from said base to said rod, and said base having an upper axially facing surface including said conical portion surface, and said base further including an inverted skirt peripherally mounted thereon;

c) a flexible, resilient, tubular grommet having an axial through passageway, said grommet including a lower portion defining an inverted dome-shaped axially downwardly facing surface having a lip about the passageway, and said grommet further including an upper axially extending portion surrounding said valve stem, said grommet extending up through said connector opening and being disposed around said valve stem base closely adjacent said inverted dome-shaped surface, said grommet having an upper face about said passageway and said surface of said valve stem head facing said valve stem base being sized to normally dwell on said upper grommet face, said lip of said grommet being at the lowermost point if said downwardly facing surface confronting the upper surface of said valve stem base, said grommet and valve stem being sized and configured with the lip in a normal position in close adjacent relation to said conical surface;

d) mutually interengaging means on the grommet and on said connector to sealingly close about the edge of said vertical opening;

e) said grommet lip comprising a sealing ring in said passageway in sealing engagement with said generally conical surface of said rod when said valve is installed in closing relation of the open upper end of a pressurized container and axially upwardly directed forces are exerted on said valve stem base, said grommet lip comprising an annular, deformable, pointed grommet portion of generally triangular transverse cross-section as seen in elevation with the apex of said grommmet portion defining a generally radially, inwardly and downwardly pointed, distally weakened, lip portion for sealing engagement with said conical portion if said rod, said inverted dome-shaped axially downwardly facing surface and lip apex being effective to deformingly and sealingly contact said upper axially facing surface including said conical portion surface when the container is under elevated, initial pressure to prevent "blow-by" of pressurized liquid and to eliminated entrapment of entrained solids between said grommet and valve stem, and as the pressure is reduced on removal of the flowable material from the container, said inverted dome-shaped axially downwardly facing surface and said pointed distally weakened portion are adapted to gradually relax returning toward is normal position with the apex of said lip portion maintaining sealing contact with the conical portion; and f) an open-topped vertically extending cover releasably secured to the tubular portion of said grommet above said connector opening for removal of said cover and cleaning of said rod, rod head, cover and grommet, said cover being of rigid material and having an inside surface closely adjacent the upper vertically extending tubular grommet, so that when the cover is tilted sideways by finger pressure, said grommet will yieldingly tilt together with said rigid valve stem from said vertical position causing a corresponding tilt of said stem base and rod out of sealing engagement of the apex of said grommet lip and said upwardly facing surface including said conical portion surface of said rod for temporarily dispensing pressurized flowable material from said container, the elasticity of said grommet automatically returning said stem to a sealing position with aid of the lip again being in sealing engagement of said conical portion upon removal of said tilting pressure.

2. The valve set forth in claim 1 wherein said valve stem base and said inverted skirt define a circular path for the product to be dispensed.

3. The valve set forth in claim 1 wherein the bisectrix of said apex is generally perpendicular to the surface of said generally conical rod portion surfaces.

4. The valve set forth in claim 1 wherein said grommet is of elastomeric plastic rubbery material.

5. The valve set forth in claim 1 wherein said edge is disposed next to axially above said stem base.

* * * * *